US005379692A

United States Patent [19]

Haug

[11] Patent Number: 5,379,692

[45] Date of Patent: Jan. 10, 1995

[54] APPARATUS FOR LABEL TRANSPORT

[75] Inventor: Werner Haug, Langnau, Switzerland

[73] Assignee: Frama AG, Lauperswil, Switzerland

[21] Appl. No.: 22,379

[22] Filed: Feb. 22, 1993

[30] Foreign Application Priority Data

Mar. 10, 1992 [CH] Switzerland ..... 00755/92-8

[51] Int. Cl.[6] ..... B41F 13/56

[52] U.S. Cl. ..... 101/227; 101/91

[58] Field of Search ..... 101/288, 91, 226, 228, 101/227; 400/621, 611, 614, 586, 593; 226/47

[56] References Cited

U.S. PATENT DOCUMENTS

| | | | |
|---|---|---|---|
| 4,568,950 | 2/1986 | Ross et al. | 101/288 |
| 4,926,191 | 5/1990 | Takenaka et al. | 400/621 |
| 4,981,378 | 1/1991 | Krämer | 101/288 |

*Primary Examiner*—Ren Yan
*Attorney, Agent, or Firm*—Ladas & Parry

[57] ABSTRACT

To avoid a deformation of the label strip (3) of a label transport apparatus in a reversing guide (10) during a long period of disuse, the drive motor (29) is reversible, so that at the end of a transporting sequence the label strip (3) is transported back until it has left the reversing guide (10).

3 Claims, 3 Drawing Sheets

1
2
3
4
5
6
8
9
10
11
12
14
15
16
17
18
19
20
24
25
26
27
29
37
38
40
52

APPARATUS FOR LABEL TRANSPORT

BACKGROUND OF THE INVENTION

The invention relates to an apparatus for label transport, particularly adhesive labels for a franking machine, with a label roll carrier for labels stored in strip-like manner, at least two guideways for the label strip arranged at an angle to one another and passing into one another via a reversing guide, at least one transport roller pair located in a guideway and connected to an electric motor, a cutter for cutting off individual labels, an electronic control unit for the control of the motor and a signalling device located on one of the guideways and connected to the control unit.

An apparatus of this type in a conventional construction suffers from the disadvantage that when the label transport is not used, the label strip remains in the reversing area between the guideways and is bent. In the case of prolonged disuse there is a corresponding permanent deformation of the label located in this strip area, so that after leaving the apparatus, due to its arcuate configuration, it is difficult to handle for adhering to an article, e.g. a letter. This disadvantage is particularly pronounced in the case of franking machines equipped with such an apparatus, because the franking machine usually directly applies the franking impression to an envelope, instead of to a franked label, so that said transport mechanism is generally subject to longer periods of disuse.

SUMMARY OF THE INVENTION

The problem of the invention is to obviate the aforementioned disadvantage and to provide an apparatus which, even after periods of disuse, makes it possible to provide undeformed labels. According to the invention this problem is solved in that the electric motor is reversible by the control unit, so that following the cutting off of a label the label strip can be moved back to at least the start of the reversing guide.

DESCRIPTION OF THE DRAWINGS

The invention is described in greater detail hereinafter relative to the drawings, wherein show:

FIG. 8 A representation of the guideways of the apparatus according to FIG. 1 located in one plane.

DETAILED DESCRIPTION OF PREFERRED EMBODIMENTS

Figures 1, 2:
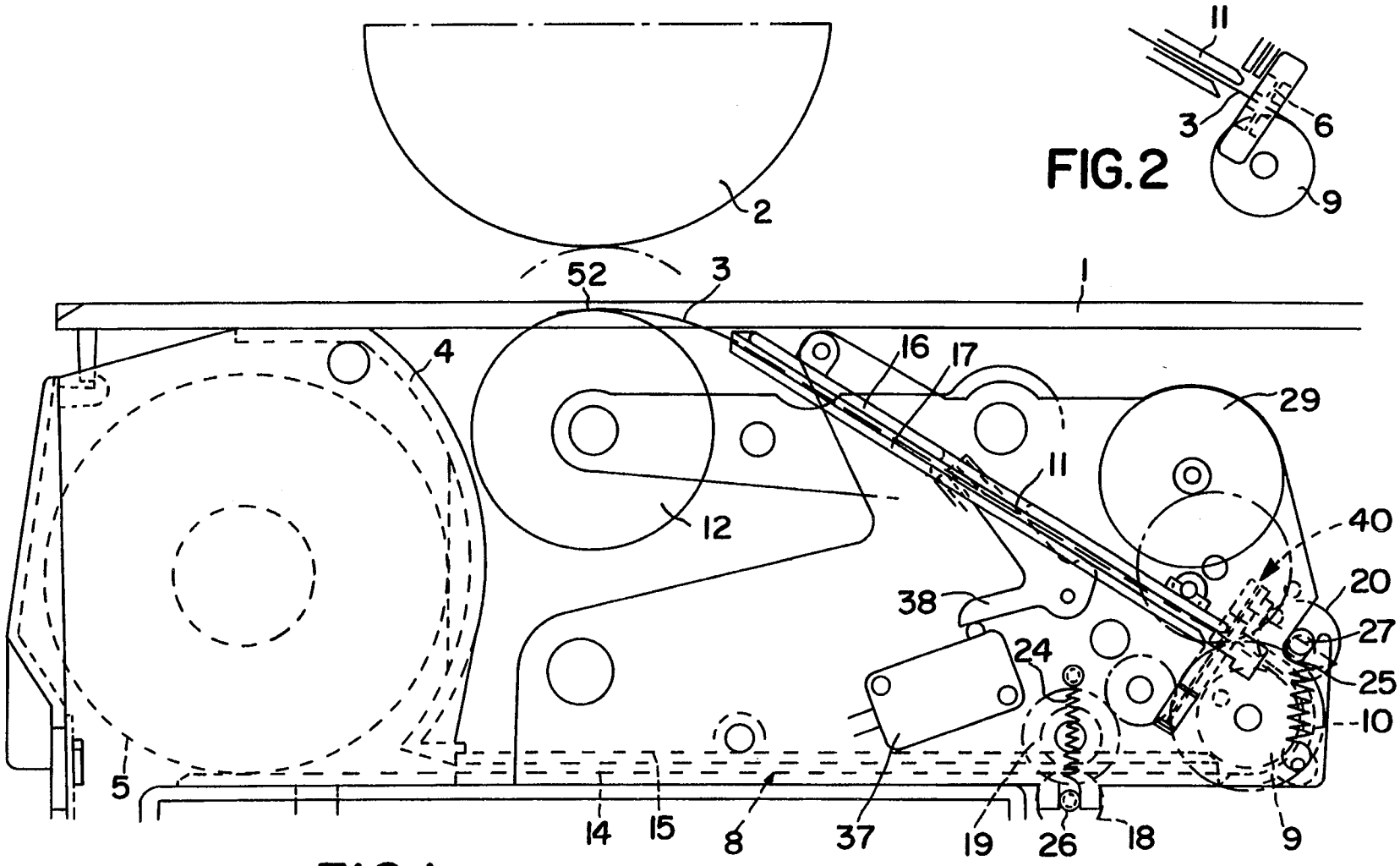
FIG. 1 A side view of an apparatus according to the invention positioned below a franking table.
FIG. 2 A detail view with a photocell located on the cutter.
Figure 3:
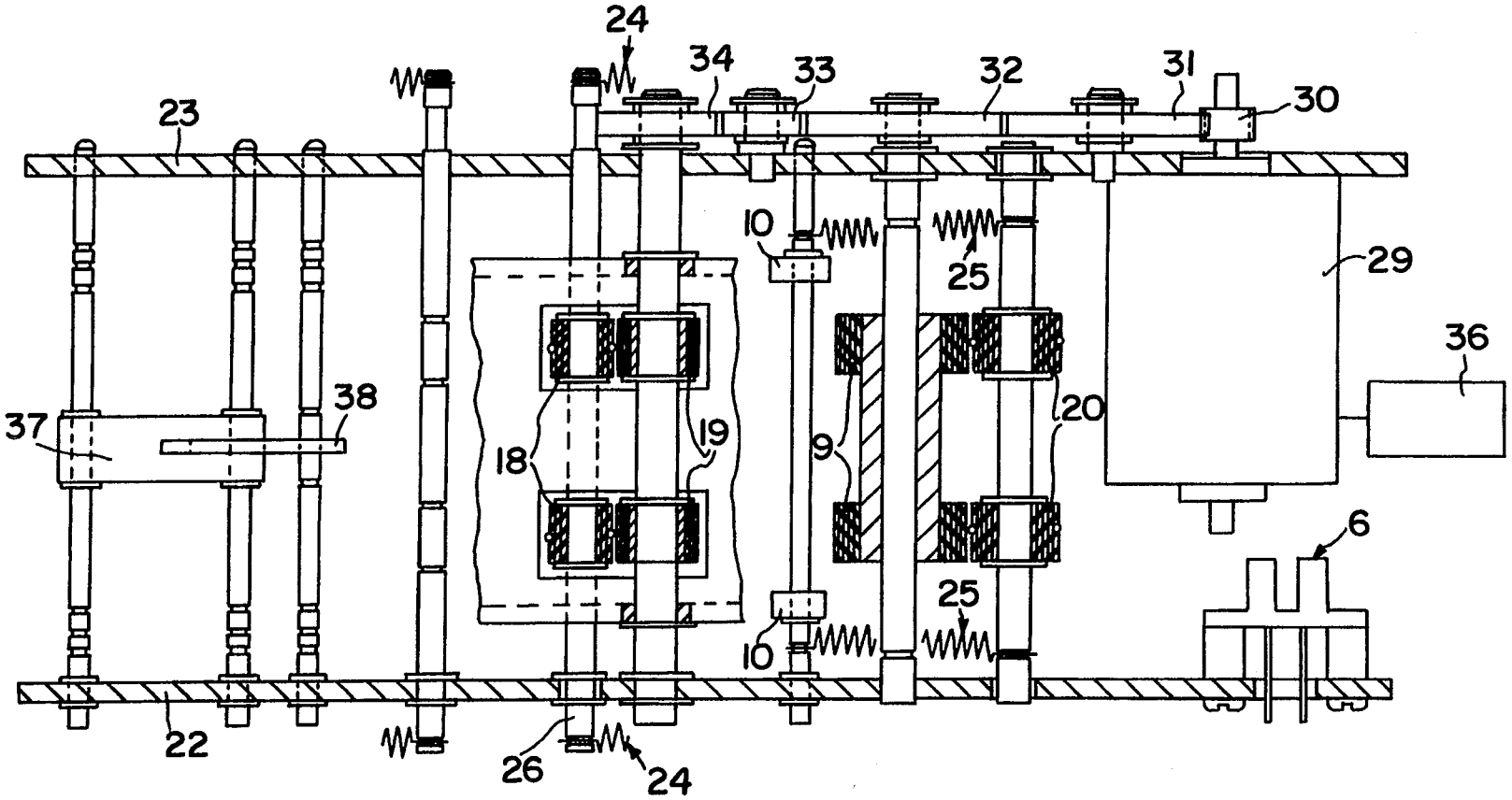
Figure 6:
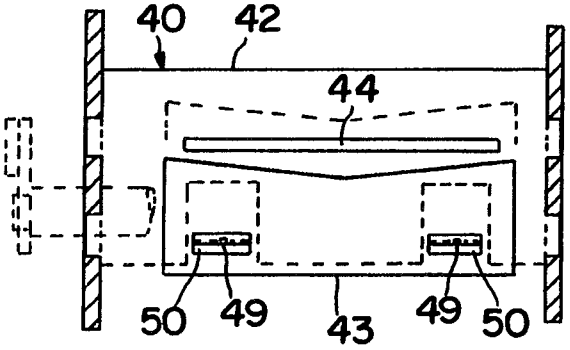
FIG. 6 A sectional representation of the cutter in the blade plane.
Figure 4:
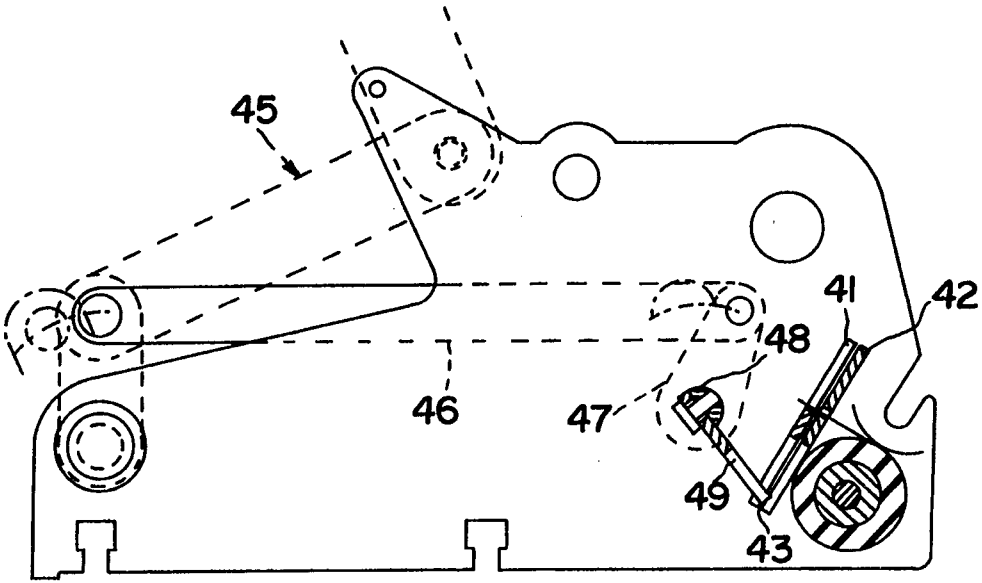
FIG. 4 A partial representation of the apparatus in the vicinity of the cutter.
Figure 5:
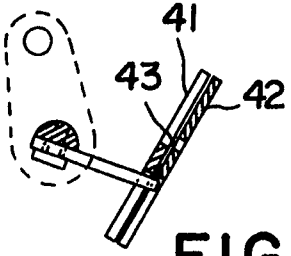
FIG. 5 A detail of the cutter in a second blade position.

The apparatus according to the invention, shown on a somewhat smaller scale, is positioned in the represented embodiment below the franking table of a franking machine having the printing or franking head 2. The adhesive labels are adhered to a label strip 3, which is e.g. 50 mm wide. Approximately 160 labels of 40×138 mm are in each case adhered to a strip length of 146 mm on the label roll 5 enclosed in a container 4. With a corresponding spacing of 146 mm the label strip 3 has markings which are read by the photocell 6.

From the label roll 5 the label strip 3 passes through a lower guideway 8 to a reversing guide 10 surrounding a transport roller 9 and from there to an upper guideway 11, which is positioned at an acute angle to the lower guideway. At the end of the upper guideway 11 the label strip 3 passes onto the transport roller 12 of the franking table, which can be pivoted upwards against the franking head 2 for franking purposes. The lower and upper guideways 10, 11 have in each case two parallel guide plates 14,15;16,17, which form a guidance gap between them.

For transporting the label roll 5 to the transport roller 12 of the franking table there are two transport roller pairs 18,19;9,20, which are in each case formed by a driven roller 19,9 and a pressure roller 18,20. They are mounted in the side walls 22,23 of the franking table frame. In each case two springs 24,25 push or pull the spindle 26,27, which is displaceable in a slot, of the pressure roller 18,20 in the direction of the driven roller, so that the label strip 3 is gripped and transported between the rollers. From the electric motor 29 the drive takes place by means of gears 30 to 34. The motor is controlled by a diagrammatically indicated, programmed, electronic control unit 36, which inter alia receives instructions from the photocell 6 and from a "label" key provided on the keyboard of the franking machine. The photocell cooperates with a mechanical switch 37 located on the upper guideway 11 and which switches it on in each case. For switch operation a sensing lever 38 is depressed by the start of the label strip 3.

For separating or cutting off a length of the label strip 3 having a label, at the start of the upper linear guideway 11 or at the end of the reversing guide 10 is provided a cutter 40. It has a movable knife or blade 43 guided between two fixed knife or blade plates 41,41. The label strip 3 passes thereto through a slot 44 of the knife plate 42. The knife 43 can be driven from a separate motor. In use on a franking machine the drive is taken from the working mechanism 45 of the franking machine pressure roller 12 movable against the franking head 2 and is passed by means of a driving rod 46 to a crank 47, which rotates a crankshaft 48 for knife operation. For this purpose a driver is fixed to the crankshaft and engages with its two ends in slots of the knife 43.

For the start of the operating sequence of the apparatus it is necessary to firstly slide the free end of the label roll 5 into the lower linear guideway 8 up to the first transport roller pair 18,19 and to start the motor 29 by operating the "label" key. The label strip 3 is then transported around the reversing guide 10 to the second transport roller pair 9,20 and subsequently through the slot 44 of the cutter 40 into the upper, linear, upwardly sloping guideway 11. In the latter the label strip 3 presses the paper sensing lever 38 downwards, so that the photocell 6 is switched on. Transportation continues until a mark on the label strip 3 is detected by the photocell. The signal from the photocell 6 stops the drive of the label strip by the electric motor 29 and the main franking machine motor is started. As the counter-pressure roller 12 then moves against the printing head 2, the part of the label strip 3 carrying the label is cut off by the cutter 40. When the counter-pressure roller 12 presses against the printing head 2, the front end 52 of said label strip portion is engaged by the driven printing head 2 and consequently prints the same. Subsequently the rotary movement of the printing head brings about the transporting away on the left-hand end of the franking table, from which it can be manually removed.

If a continuous series of labels is not supplied to the printing head 2 for printing with the same franking value, during the performance of the printing operation the control unit 36 in each case brings about a polarity reversal of the motor 29, so that the portion of the label strip 3 located in the reversing guide 10 is transported back by approximately 40 to 60 mm into the lower, linear strip guide 8. The free or front end of the label strip 3 is then located between the first and second transport roller pairs 18,19; 9,20. This avoids any distortion of part of the label strip 3. If the label key is again depressed, there is a forward transport of the label strip 3 in the above-described manner until the photocell 6 again detects a mark.

What is claimed is:

1. An apparatus for label transport, particularly adhesive labels for a franking machine having a printing station, said apparatus comprising:

a label roll carrier for labels stored in strip-like manner for feeding to said printing station;

at least two guideways disposed between said label roll carrier and said printing station for guiding the label strip along a prescribed path to said printing station;

a reversing guide disposed in between said two guideways for altering the path of the label strip, said two guideways being arranged to form a non-linear path and communicating with one another via the reversing guide;

a reversible motor;

at least one transport roller pair located in one of the guideways and connected to said reversible motor;

a cutter for cutting off individual labels;

an electronic control unit for controlling said reversible motor; and a signalling device located on one of the guideways and connected to the control unit, for signalling that the label strip is in a position to begin a printing operation; and wherein said control unit reverses said reversible motor after completion of each printing operation, so that, following the cutting off of the last label of each printing operation, the label strip is moved back around the reversing guide to position the leading edge of the label strip on the opposite side of the reversing guide from the printing station.

2. An apparatus according to claim 1, wherein one of the guideways is a linear guideway positioned upstream of the reversing guide in the transport direction.

3. An apparatus according to claim 2, wherein the linear guideway is formed by two guide plates which are parallel to one another and enclose a guidance gap.

* * * * *